US006783922B2

(12) United States Patent
Kluijtmans et al.

(10) Patent No.: US 6,783,922 B2
(45) Date of Patent: Aug. 31, 2004

(54) PHOTOGRAPHIC MATERIAL CONTAINING A SCAVENGER-MODIFIED POLYMER

(75) Inventors: Sebastianus Gerardus J. M. Kluijtmans, Utrecht (NL); Jan Bastiaan Bouwstra, Bilthoven (NL); Yuzo Toda, Goirle (NL)

(73) Assignee: Fuji Photo Film, B.V., Tilburg (NL)

( * ) Notice: Subject to any disclaimer, the term of this patent is extended or adjusted under 35 U.S.C. 154(b) by 97 days.

(21) Appl. No.: 10/182,353

(22) PCT Filed: Jan. 26, 2001

(86) PCT No.: PCT/NL01/00053

§ 371 (c)(1),
(2), (4) Date: Oct. 28, 2002

(87) PCT Pub. No.: WO01/55788

PCT Pub. Date: Aug. 2, 2001

(65) Prior Publication Data

US 2003/0198904 A1 Oct. 23, 2003

(30) Foreign Application Priority Data

Jan. 26, 2000 (EP) ..... 00200275

(51) Int. Cl.[7] ..... G03C 7/30; G03C 7/396; G03C 8/52

(52) U.S. Cl. ..... 430/504; 430/214; 430/505

(58) Field of Search ..... 430/214, 504, 430/505

(56) References Cited

U.S. PATENT DOCUMENTS

| | | | | |
|---|---|---|---|---|
| 3,765,893 A | | 10/1973 | Lohmer | 430/505 |
| 3,772,014 A | * | 11/1973 | Scullard | 430/214 |
| 4,345,016 A | * | 8/1982 | Takahashi et al. | 430/214 |
| 4,983,506 A | | 1/1991 | Ono et al. | 430/214 |
| 6,045,988 A | * | 4/2000 | Helling et al. | 430/551 |

FOREIGN PATENT DOCUMENTS

| | | |
|---|---|---|
| DE | 19730468 | 6/1999 |
| JP | 04062548 | 6/1992 |

* cited by examiner

*Primary Examiner*—Richard L. Schilling
(74) *Attorney, Agent, or Firm*—Banner & Witcoff, Ltd.

(57) ABSTRACT

The invention is directed to a photographic material, comprising a photographic support and color sensitive recording layers on top of said support, said recording layers being separated from each other by interlayers, wherein the interlayers are characterized by the interlayer design parameter $\{[SC]*d^2\}$ (wherein [SC] is the concentration scavenger moieties bound to the water soluble polymer applied in the interlayer per gram total interlayer polymer and the dry thickness of the interlayer) having a value larger than $2.0*10^{-15}$ mmol $m^2$/g and a maximum concentration [SC] of 0.5 mmol/g.

32 Claims, 2 Drawing Sheets

PHOTOGRAPHIC MATERIAL CONTAINING A SCAVENGER-MODIFIED POLYMER

FIELD OF THE INVENTION

The present invention is directed to the field of photographic materials containing scavenger molecules that are applied in the intermediate interlayers between the photographic sensitive emulsion layers.

BACKGROUND OF THE INVENTION

Colour photographic elements are conventionally formed with blue, green and red recording layers coated on a film support. The blue, green and red recording layers contain radiation-sensitive silver halide emulsions that form a latent image if irradiated by blue, green and red light, respectively. The blue recording layer contains a yellow dye image-forming coupler, the green recording layer contains a magenta dye image-forming coupler and the red recording layer contains a cyan dye image-forming coupler. After the photographic element is exposed by an image, it is processed in a colour developer, which contains a colour developing agent that is oxidised by the selective reduction of the silver in the silver halide grains with the formation of the silver latent image. The oxidised colour developing agent then reacts with the dye image-forming coupler in the vicinity of the developed grains to produce an image dye. Yellow (absorbs blue light), magenta (absorbs green light) and cyan (absorbs red light) image dyes are formed in the blue, green and red recording layers respectively. Subsequently the photographic element is bleached (i.e. developed silver is converted back to silver halide) in order to eliminate the neutral density attributable to developed silver and then fixed (i.e. silver halide is removed) in order to provide stability during subsequent handling at room light conditions.

When processing is conducted as noted above, negative dye images are produced. To produce a viewable positive dye image and hence to produce a visual approximation of the hues of the subject photographed, white light is typically passed through the colour negative image to expose a second photographic element also having blue, green and red recording layers as described above, usually coated on a white reflective paper support. The second element is commonly referred to as a colour print element and the process of exposing the colour print element through the image bearing colour negative element is commonly referred to as printing. Processing the colour print element at the same way as described above for the negative film support produces a viewable positive image that approximates that of the subject originally photographed.

Both photographic elements, the colour negative film and the colour positive paper supports, contain radiation-sensitive silver halide emulsions in the blue, green and red recording layers. Image dyes are formed by the reaction of the oxidised developer molecules with the dye image-forming coupler. The oxidised developer molecules can migrate easily from one colour recording layer into another colour recording layer, which will cause imbalances in colour reproduction because a wrong colour dye is generated in an other recording layer. This phenomenon is called colour mix or colour contamination. In order to prevent this diffusion travelling of the oxidised developers the photographic elements contain scavenger molecules which are able to neutralise the oxidised molecules and preventing that a colour coupler forms the wrong colour dye in an other recording layer. Sometimes a certain (limited) amount of colour mix may be desirable for a better appearance of the image. This makes the design of the interlayer a complicated matter. The scavenger molecules are conventionally present in the intermediate interlayers between the different colour recording layers of the colour negative film but also in the same way at the colour positive paper support. The scavenger molecules are dissolved in an oil-in-water emulsion and as such integrated in the interlayers. An important disadvantage of the scavenger oil-water emulsion is that by increasing the quantity of oil-water emulsion the sharpness quality is negatively influenced due to increased scattering chances.

It has been described in EP-A 576911 to couple functional carboxylic acid groups of R—COOH compounds to the amine groups of gelatine The coupling of scavenger molecules to a polymer compound has already been described in JP-4062548, said polymers being applied in the interlayers of photographic products. The use of water-soluble polymers (proteins, polyvinyl alcohol (PVA), polyvinyl glycol (PVG)) coupled to different scavenger molecules is disclosed. The scavenger modified polymer molecules in the interlayers result in reduced colour contamination effects while also the photographic sensitivity after ageing is improved versus the conventional recipes in which the scavenger molecules are dissolved in the oil-water emulsion of the interlayers. The amount of scavenger modified polymer per square meter is disclosed over a very broad range from 1 mg to 20 g per square meter.

SUMMARY OF THE INVENTION

The present invention is based upon the surprising insight that the use of a specific concentration range of scavenger moieties in a scavenger modified polymers in combination with specific values for the thickness of the interlayer layer, results in a highly effective scavenging function against the migrated oxidised developer molecules whereas we found that the concentration of scavenger should be limited to prevent reduction of the maximum density $D_{max}$ in the colour recording layer.

The specific combinations of layer thicknesses and scavenger concentrations, which combinations are used in accordance with the present invention are conveniently expressed by a single design parameter. In this interlayer design parameter, the dry thickness of the interlayer (called d) is combined with the concentration of scavenger moieties in the interlayer (called [scavenger]). It was found that the design parameter $\{[\text{scavenger moiety}].d^2\}$ predicts the scavenging extend of the migrated oxidised developer molecules. Using this new interlayer design parameter it has thus become possible to specify a range of specific thicknesses in combination with a specified concentration range of scavenger moieties in the interlayer for which acceptable colour contamination happens in the colour recording layers as well as no reduction of the maximum density $D_{max}$, while the dye fading and the sharpness quality of each colour recording layer improve.

Accordingly the invention comprises in its broadest scope a photographic material, comprising a photographic support and color sensitive recording layers on top of said support, said recording layers being separated from each other by interlayers, wherein the interlayers are characterised by the color mix predictive product function {[scavenger moiety].$d^2$}>$2.0*10^{-15}$ mmol $m^2$/g. In preferred embodiments the value of the product function is larger than $5.0*10^{-15}$ mmol $m^2$/g, most preferably larger than $10.0*10^{-15}$ mmol $m^2$/g.

The present invention is in a preferred embodiment directed to a photographic material containing scavenger modified polymers comprising scavenger moieties linked to a water soluble polymer, which polymers are applied in the interlayers, so that a concentration of scavenger moieties in the scavenger modified polymer that is lower than 0.5 mmol/g total polymer in the interlayer. In preferred embodiments these values are lower than 0.30, most preferably lower than 0.15 mmol/g polymer.

One of the additional advantages of the present invention is, that photographic material can be provided having one or more interlayers, with a thickness and scavenger concentration that is exactly tuned to meet the required specifications with respect to $D_{max}$ and color mix. This makes it possible to provide materials having interlayer thicknesses that are smaller than those of conventional materials.

In the present invention the reactive group (carboxylic acid, amine) of the scavenger compound is linked with the reactive groups (amine, carboxylic acid) of the water-soluble polymer, preferably gelatine. To increase the load of scavenger in the preferred polymer, gelatine, it is also possible to use part of the abundantly available carboxylic groups of the gelatine by amidation with ethylene di-amine with the N-HydroxySuccinimide (NHS)/carbodiimide system. It is also possible to use the carboxylic groups of the gelatine and to connect these with the amino group of the scavenger. Therefore the gelatine is, initially, activated with a carboxylic activating agent. The activated carboxyl group reacts with an amine containing scavenger compound to form the modified gelatine, as described in EP-A 0 576 912.

In case it is preferred to increase the load of scavenger in the polymer even further, one or more spacers can be inserted between the scavenger moiety and the polymer.

The scavenger modified polymer is much more efficient to scavenge oxidised developer molecules, as compared with the scavenger molecule dissolved conventionally in the oil-water emulsion of the interlayer for the prevention of colour contamination, because the migration of oxidised developer molecules from one colour recording layers into another is prevented much more efficiently.

According to the invention it has been found that the applicable range of scavenger modified polymer is much smaller than taught by the Japanese patent application cited hereinabove, because at the low scavenger modified polymer concentration and inter layer thickness from the disclosed application significant colour contamination happens which destroys the quality of the photographic image while at higher scavenger modified polymer concentrations the maximum density $D_{max}$ drops which is unacceptable for colour reproduction as well. This reduction of the maximum density $D_{max}$ was not recognised at all in the said patent application.

An advantage of the present invention is the improvement of sharpness because there is no oil present anymore to scatter the light. Moreover, the image sharpness can be maximized by using the interlayer design parameter to minimize the thickness of the interlayer.

Other effects and advantages of the present invention will become apparent from the detailed descriptions below, taken in connection with the accompanying drawings, wherein, by way of illustration and example, an embodiment of the present invention is disclosed.

DETAILED DESCRIPTION OF THE INVENTION

Surprisingly it has been found that it is possible to find a specific concentration range of the scavenger moieties attached to the modified polymer molecules (called [scavenger]) in combination with a specific thickness (called d) of the interlayer between the different colour recording layers which are combined into an interlayer design parameter {[scavenger moiety].$d^2$} that defines the scavenging of the migrated oxidised developer molecules from a colour recording layer into the interlayer. The values of the design parameter can be chosen to meet color mix requirements of the light recording material without resulting in detrimental effects on the other photographic properties as the maximum density $D_{max}$, while dye fading and the sharpness of each colour recording layer improve. It is well known to an expert in the field that for some light recording materials it is desirable to have a certain small amount of color mix to improve the color reproduction quality of said material.

In particular the invention is based thereon that the design parameter {[scavenger moiety].$d^2$} is not lower than $2*10^{-15}$ mmol $m^2$/g, since lower values give rise to unacceptable colour mix. Preferably this value is larger than $5*10^{-15}$ mmol $m^2$/g, since for these values minor amounts of colour mix can be used to improve image quality in some cases. Most preferably this value is larger than $10*10^{-15}$ mmol $m^2$/g, in order to effectively prevent oxidised developer diffusion and hence to reach an acceptable level of color mix.

Moreover the invention is based thereon that no decrease of the $D_{max}$ was found when the concentration of the scavenger moieties attached to the water soluble polymer does not exceed 0.5, preferably 0.30, most preferred 0.15 mmol/g otherwise also the oxidised developer molecules in the colour recording layers will be scavenged which results in a drop of the maximum density $D_{max}$ of each colour recording layer.

According to the invention it has thus become possible to provide on one hand a scavenger modified polymer in the interlayer which scavenges oxidised developer molecules more effectively at the same maximum density $D_{max}$ of each colour recording layer if the interlayer design parameter {[scavenger moiety].$d^2$}, preferably, remains smaller than $700*10^{-15}$ mmol $m^2$/g polymer for the interlayers than applying the scavenger molecules in the conventional oil-water emulsions.

Most preferably the interlayer design parameter {[scavenger moiety].$d^2$} for the interlayers between the color recording layers remains within the range of $40*10^{-15}$ mmol $m^2$/g polymer and $250*10^{-15}$ mmol $m^2$/g polymer.

As was already stated herein-above, one of the additional advantages of the present invention is, that photographic material can be provided having one or more interlayers, with a thickness and scavenger concentration that is exactly tuned. This provides for photographic materials having thinner interlayers, which thus may produce sharper images. In fact. it was found that material, such as photographic film or paper, can be provided in which the thickness of the interlayer is up to 30–50% less than the thickness of interlayers in conventional materials. In conventional photographic materials, usually the dry thickness of the interlayer is larger than 1.5 $\mu$m. According to the present invention, however, thicknesses of less than 1.5 $\mu$m, preferably less than 1.0 $\mu$m, may be obtained. The use of thinner interlayers provides for the distinct advantages that photographic material is obtained that gives much sharper images, while the specifications of the material with respect to $D_{max}$ and color mix are maintained.

The small ranges of the interlayer design parameter {[scavenger moiety].$d^2$} in our invention as compared with the large concentration range of the scavenger modified polymers as disclosed in JP-4062548 A, indicate that the prior-art patent does not take into account the detrimental effect on most important photographic qualities like the colour contamination and the maximum density $D_{max}$ as our invention shows outside the specified limits of the interlayer design parameter {[scavenger moiety].$d^2$} Moreover, JP-4062548 A is silent with respect to layer thicknesses.

The scavenger molecules to be used for the chemical linking with the polymers to be applied in the interlayer of the photographic product are selected from the scavenger molecules which are conventionally also used in the photographic oil-water emulsion of the interlayers. The molecular structure of the scavenger molecules is based upon a cresol type of molecule, a pyrogallol type, a cathechol type, a hydrochinon type or a 2,4-disulphonamidophenol type. More typical examples of scavenger molecular structures are shown in the figures attached hereto. The preferred scavenger structure for our invention is the 2,5-dihydroxybenzoic acid molecule.

The polymer molecules to be used for the chemical linking with the scavenger molecules, which are applied in the interlayers of the photographic products, are selected from the same molecules, which are conventionally used in the photographic oil-water emulsion of the interlayers. The molecular structure of the water soluble polymer molecules is selected from the group consisting of casein, albumin, sericin, soluble collagen, gelatine, polyvinyl alcohol, polyvinyl glycol, polyvinyl pyrrolidone, poly acrylamide, polyvinyl-imidazole, polyvinyl-pyrazole, cellulose derivatives, saccharine derivatives and the like. The preferred water soluble polymer structure for our invention is gelatine which can be obtained from natural gelatines, alkaline processed gelatine, acid processed gelatine, hydrolysed gelatine, peptised gelatine resulting from enzymatic treatment and recombinant gelatines.

The chemical linking between the activated carboxylic acid active groups of the scavenger molecules with the free amine groups of the polymers (like the pendant amine groups (lysine and hydroxy-lysine) of gelatine) is a well known synthesis route for the production of an amide, as is shown in disclosure EP-576911 A2. The activation of the carboxylic acid groups of the scavenger molecules can be carried out by various methods. In our example the method of N-hydroxy-succinimide (NHS)/DiCyclohexylCarbodiimide (DCC) in an organic solvent, such as organic solvent acetonitril, tetrahydrofuran, 1,3-dioxane or 1,4-dioxane, preferably tetrahydrofuran, has been used for activation. Another way to produce an amide is possible by linking the (activated) carboxylic acid end groups of gelatine amino acids (glutamine and asparagine) to the amine-moieties of the scavenger molecules.

The interlayers may be applied in various ways in the photographic material. At least one of said interlayers may consist of one homogeneous layer containing the said scavenger modified polymer or of a core layer with shield layers on both sides of the said core layer, in which each of the said shield layers contain a different concentration of the said scavenger modified polymer, or of a core layer containing the said scavenger modified polymer with shield layers on both sides of the said core layer, in which said shield layers do not contain a scavenger modified polymer.

As photographic supports photographic base paper is used which contains a polymer resin coated layer at the topside of the base paper and optionally at the backside of said base paper. At the topside above the polymer resin coated layer several photographic colour recording layers are coated in which the interlayers between the different colour recording layers contain the scavenger modified polymers which are described in this invention.

The invention of the scavenger modified polymers is also directed for various other photographic and movie products, e.g. photographic film, movie film and Reverse Colour Paper (RCP). Photographic film supports comprises films composed of polyethylene terephthalate, polyethylene naphthalate or triacetylcellulose and the like. At the topside of the film a multi-layer of different colour recording emulsion layers are coated which contain interlayers between the various colour recording layers comprising the invented scavenger modified polymers. Movie film also comprises the same support materials as photographic film, but the multi layer coating comprises other colour couplers and sensitisers. RCP comprises the same support as normal Colour Paper, but again, the colour recording layers comprise other colour couplers and other added components. As couplers use can be made of the couplers described, for example, in JP Patent 9-171240.

The processes and chemicals used in the development and bleaching processes are extensively described in the *Research Disclosure* 40145 of September 1997, Chapter XXIII: "Exposure and Processing, p 635–p 650. Preferred colour developing agents for colour paper are: 4-amino-3-methyl-N-ethyl-N-(b-hydroxyethyl)aniline sulphate, 4-amino-3-methyl-N-ethyl-N-(b-methanesulphonamidoethyl)aniline sesquisulphate hydrate and for colour film process the preferred developing agents are: o-, or p-amino phenol, p-phenylene diamine derivatives.

Figure 1:
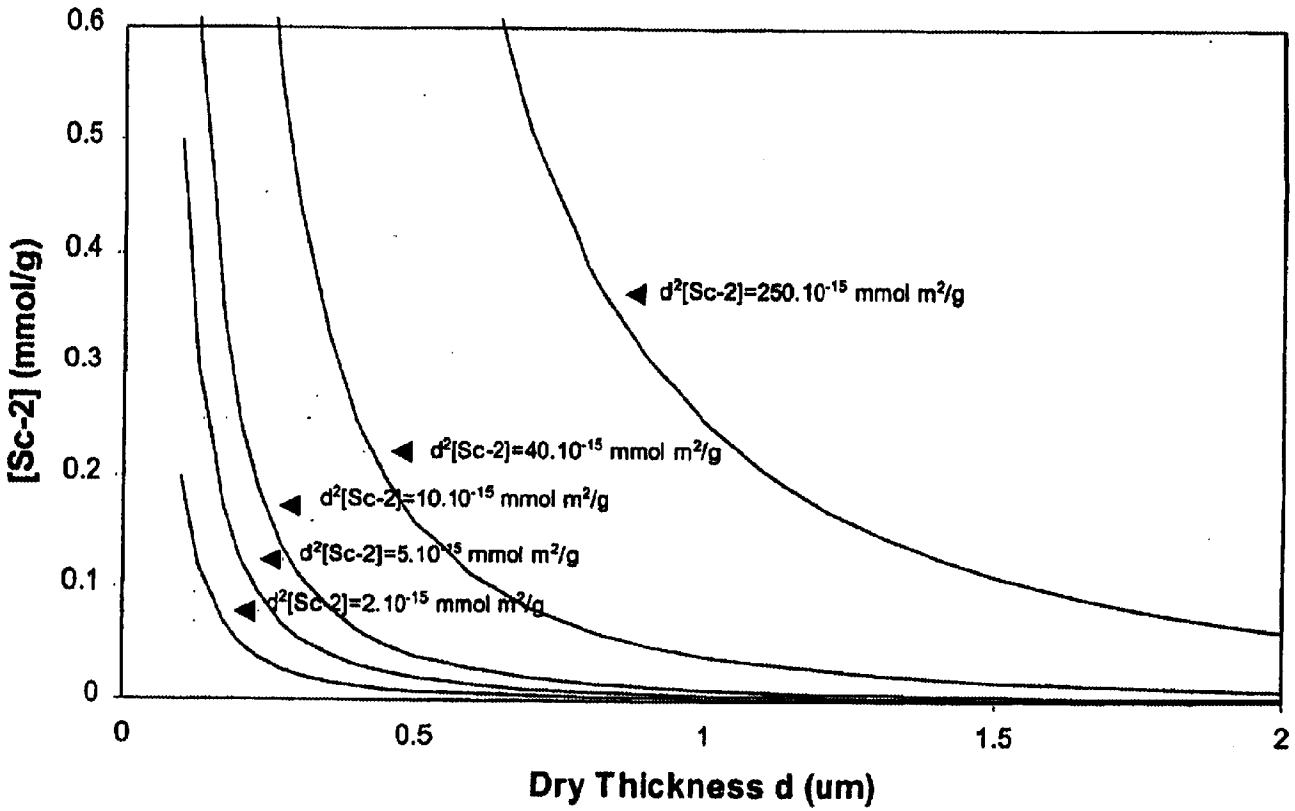
FIG. 1 is an illustration of iso-colour mix lines found according to the invention. The lines represent constant values of the interlayer design parameter {[scavenger moiety].$d^2$}, hence having the same colour mix density

The invention is now further elucidated on the basis of the following examples:

EXAMPLES

Example 1 (Comparative Example)

Scavenger Molecules Dissolved in an Oil-Water Emulsions of Interlayers for Photographic Colour Paper Application.

The front side of the base paper is coated with a polyethylene resin and a conventional small subbing layer consisting of gelatine. On top of the subbing layer the following 8 emulsion layers are coated in which the used amounts are expressed in milligrams per square meter, while the amount of silver halide is represented by the amount of silver:

| Layer structure of comparative sample | |
|---|---|
| Layer 1: BLU comprised of blue-sensitised cubic silver bromide emulsions | |
| AgBr | 71 |
| Yellow coupler (C-1) | 140 |
| Emulsified in oil (oil-1) | 51 |
| and gelatine | 350 |
| Layer 2: BLO comprised of blue-sensitised cubic silver bromide emulsions | |
| AgBr | 189 |
| Yellow coupler (C-1) | 371 |
| Emulsified in oil (oil-1) | 135 |
| and gelatine | 929 |
| Interlayer 3: BMC contains the scavenger compound for oxidised developer molecules | |
| Scavenger compound (SC-1) | between 0 and 0.57 mmol/g polymer |
| | 544 |
| Emulsified in oil (oil-2) | 1112 |
| and gelatine | |
| Layer 4: GL comprised of green-sensitised cubic silver bromide emulsions | |
| AgBr | 131 |
| Magenta coupler (C-1) | 117 |
| Emulsified in oil (oil-3) | 494 |
| and gelatine | 1189 |
| Layer 5: GMC contains the scavenger compound for oxidised developer molecules | |
| Scavenger compound (SC-1) | between 0 and 0.49 mmol/g polymer |
| Emulsified in oil (oil-2) | 276 |
| and gelatine | 654 |
| Layer 6: RL comprised of red-sensitised cubic silver bromide emulsions | |
| AgBr | 200 |
| Cyan coupler (C-3) | 259 |
| Emulsified in oil (oil-4) | 198 |
| and gelatine | 905 |

-continued

| Layer structure of comparative sample |
|---|
| Layer 7: PCU-layer containing UV-protective dyes |
| Layer 8: PCO-layer determining surface properties |

This paper was hardened at the time of coating with hardener H-1 for 1.33% by weight of the total gelatine. Surfactants, coating aids, water soluble antihalation dyes, anti-foggants, stabilisers, anti-static agents, biostats, biocides and other addenda chemicals were added to the various layers, as commonly practised in the art.

The following chemical compounds are used in the above recipe:

Oil-1=Octadecanoic acid, epoxy-, 2-ethylhexyl ester
Oil-2=Mixture of Octadecanoic acid, epoxy-, 2-ethylhexyl ester & dibutyl phthalate
Oil-3=Mixture of Trihexyl phosphate & Dibutyl sebacate & poly-isopropenylbenzene
Oil-4=Dicyclohexyl phthalate
Yellow coupler C-1=α-(1-Benzyl-2,4-dioxo-5-ethoxyimidazolidine-3-yl)-5-[2-[2,4-bis(1,1-dimethylpropyl)phenoxy]butyrylamino-2-chloro-]-(1,1-dimethylethylcarbonyl)acetanilid
Magenta coupler C-2=3-(2-tetradecyloxycarbonyl)-N-{4-(6-tert-butyl-7-chloro-1H-pyrazolo[1,5-b][1,2,4]triazol2-yl)}phenylpropanamide
Cyan couplers C-3=Mixture of 2,4-Dichloro-3-ethyl--6-(2-(2,4-di-tert-pentylphenoxy)-butyrylamino)-phenol & 3',5'-Dichloro-4'-ethyl-2'-hydroxy hexadecananilide
Scavenger compound SC-1=2,5-di(1,1,3,3-tetraylbutyl)-1,4-dihydroxybenzene
Scavenger compound SC-2=dihydroxy benzoic acid (coupled to gelatine)
Hardener=1,3,5-Triazine-2(1H)-one, 4,6-dichloro-, sodium salt.

Example 2 (Inventive Example)

Scavenger Modified Gelatine Molecules in the Interlayers of Photographic Colour Paper.

Materials: Synthesis of Scavenger Modified Gelatine Molecules:

Add 7.14 g (62 mmol) N-hydroxysuccinimide (NHS) and 12.8 g (62 mmol) dicyclohexyl-carbodiimide (DCC) to a stirred solution of 9.25 g (60 mmol) 2,5-dihydroxybenzoic acid (SC-2) and 450 ml of acetonitril. Add after filtration the solution in 5 minutes to a solution of 110 g lime-bone gelatine and 1.75 l water at 40° C. After 1 hour the solution is filtrated, dialysed, and oven dried (at 30° C.) The resulting modified gelatine has a degree of coupling of 13 mmol scavenger/100 g gelatine (35% of the amine groups is modified). Different loads of scavenger are obtained by choosing different stoichiometric amounts (varied between 5 and 25 mmol/100 g gelatine).

All emulsion layers are equal as shown in example 1, except the composition of the interlayers BMC and GMC are modified with the usage of the invented scavenger modified gelatine. The amounts are expressed in milligrams per square meter. The total amount of gelatine, which includes scavenger gelatine and non-functionalised limed bone gelatine, varied between 360 and 1820 mg/$m^2$. The concentration of covalent coupled scavenger [SC-2] was varied from 0.0 to 0.129 mmol/g gelatine in the interlayer, depending on the scavenger load of the gelatine and the ratio it is used in.

| | |
|---|---|
| Layer 3: BMC contains the scavenger polymer described in this patent | |
| Scavenger modified gelatine | varied between 0 and 1820 mg/m$^2$ |
| Gelatine (lime-bone) | varied between 360 and 1820 mg/m$^2$ |
| Layer 5: GMC contains the scavenger polymer described in this patent | |
| Scavenger modified gelatine | varied between 0 and 1820 mg/m$^2$ |
| Gelatine (lime-bone) | varied between 360 and 1820 mg/m$^2$ |

The dry layer thickness d is calculated using the coated amount per square meter speed, the total solid content of the layer, and the average density of the layer.

Example 3 (Inventive Example)

High Load Scavenger Modified Gelatin in the Interlayer of Photographic Colour Paper Materials:

A high load scavenger gelatin, with a scavenger load higher than the amount of primary amines present in a natural gelatin is, as an example, obtained according to the following procedure. The NHS-ester of 2,5-dihydroxybenzoic acid is prepared according to the same synthetic procedure as described in example 2. The NHS-DHBA ester is coupled to the two amine functionalities of lysine to form the di-substituted lysine-DHBA adduct. The NHS ester is prepared prepared from this carboxyl acid compound the NHS ester according to the procedure described above. The resulting bifunctional scavenger molecule is added to gelatin as described in example 2. The prepared scavenger modified gelatine has a degree of coupling of 61 mmol scavenger/100 g gelatine (70% of the natural amine groups of the natural gelatin is modified). Different loads of scavenger can be obtained by choosing different stoichiometric amounts of the bifunctional NHS-ester (varied between 2 and 51 mmol/100 g gelatin). The high load scavenger modified gelatin as obtained via the previously described procedure was applied as in example 2.

Photographic Evaluations of Test Samples

All types of light-sensitive material were subjected to image-wise exposure to light. They were processed continuously using a paper processor in the following processing steps.

| Processing step | Temperature (° C.) | Time (sec) | Replenisher (ml/m$^2$)* |
|---|---|---|---|
| Color developer 'Enviroprint LR' | 38 | 45 | 73 |
| Bleach-fix 'CPRA LR' | 30–35 | 45 | 70 |
| Rinse (1) | 30–35 | 30 | |
| Rinse (2) | 30–35 | 30 | |
| Rinse (3) | 30–35 | 30 | |
| Drying | ≧60 | 60 | |

*m$^2$ of the light-sensitive material

The composition of each processing solution is according the standard conditions for the mentioned type of developer for amateur colour paper.

Immediately after the processing the yellow, cyan and magenta reflection densities (D) of each sample were measured and compared with a standard.

The photographic evaluation results of the conventional scavenger molecules in the oil-water emulsions of the interlayers of a colour paper (example 1) are shown in Table 1, in which the colour mix is defined as the colour density of the other colours in the same specific recording layer. The photographic evaluation results of the invented scavenger modified gelatines in the interlayers of a colour paper (example 2) are shown in Tables 1 and 2.

TABLE 1 colour mix prevention of the intended gelatin bound scavenger compared to the conventional oil-in-water scavenger at equal layer thickness.

| | Example 1 comparative example | Example 2 invention |
|---|---|---|
| amount of scavenger moieties per m$^2$ (mmol/m$^2$) | 0.27 | 0.05 |
| Magenta Color mix in Yellow | 0.10 | 0.10 |

The design parameter {[SC-2]*d$^2$} is defined by the product of the scavenger concentration [SC-2] with the squared dry interlayer thickness d. When the scavenger concentration increases while the thickness d is reduced such that the interlayer design parameter remains about constant, the magenta color mix remains reasonably constant (=iso colour mix line), which is shown in table 2 and FIGS. 1 and 2.

TABLE 2

Iso-colour mix invention. Magenta colour mix in yellow as a function of the scavenger SC-2 concentration at comparable values of the interlayer design parameter {[scavenger moiety SC-2].d$^2$}

| Scavenger conc. [SC-2] (mmol/g | Dry layer thickness d ($\mu$m) | [SC-2].d$^2$ ($10^{-15}$mmol m$^2$/g) | Magenta colour mix CM |
|---|---|---|---|
| 0.129 | 0.50 | 32 | 0.21 |
| 0.062 | 0.72 | 32 | 0.20 |
| 0.065 | 0.72 | 34 | 0.18 |
| 0.035 | 1.02 | 32 | 0.19 |
| 0.031 | 1.02 | 37 | 0.18 |
| 0.015 | 1.53 | 35 | 0.21 |

However, in case the high load scavenger modified gelatin of example 3 is used and its concentration is increased accompanied by an increase of the layer thickness, the maximum yellow density $D_{max}$ drops significantly. For scavenger concentrations exceeding 0.5 mmol/g an unacceptable large yellow $D_{max}$ drop is observed as is shown in table 3.

TABLE 3

Colour mix and $D_{max}$-depression of the invention as applied in example 3. Colour mix of magenta in yellow and $D_{max}$ of yellow as a function of the scavenger SC-2 concentration layer thickness

| Scavenger conc. [SC-2] (mmol/g | Dry layer thickness d ($\mu$m) | [SC-2].d$^2$ ($10^{-15}$mmol mg$^2$/g) | Yellow $D_{max}$ | Magenta colour mix density |
|---|---|---|---|---|
| 0.020 | 0.30 | 1.8 | 2.05 | 0.50 |
| 0.062 | 0.72 | 32 | 2.02 | 0.20 |
| 0.202 | 1.02 | 210 | 1.96 | 0.03 |
| 0.511 | 1.20 | 736 | 1.80 | −0.01 |

The data in table 3 show that the magenta color mix density is 0.5 when the interlayer design parameter {[scavenger moiety].d$^2$} is $1.8*10^{-15}$ mmol m$^2$/g which color mix density is just too high and will not meet our quality limit of color purity and of color balance. The color mix density of 0.2, which relates to {[scavenger moiety].d$^2$}=$32*10^{-15}$ mmol m$^2$/g is acceptable and this color mix level is sometimes "designed in" to improve the quality of the color image in the high density regions. Hence an acceptable color mix prevention is obtained when the interlayer design parameter {[scavenger moiety].d$^2$}>$2*10^{-15}$ mmol.m$^2$/g.

When {[scavenger moiety].d$^2$}=$736*10^{-15}$ mmol.m$^2$/g the rather drastic Dmax down effect which we found is a not wanted consequence of the scavenging function of the interlayer and should be avoided.

Conclusions from Photographic Evaluations of the Experiments:

By comparing example 1 and 2 in table 1 it is shown that the invented polymer bound scavenger is much more effective to prevent colour mix than the scavenger applied in the conventional oil-water emulsion. In this example the modified gelatin according to the invention is a factor 5.4 more efficient than the conventional scavenger.

Figure 2:
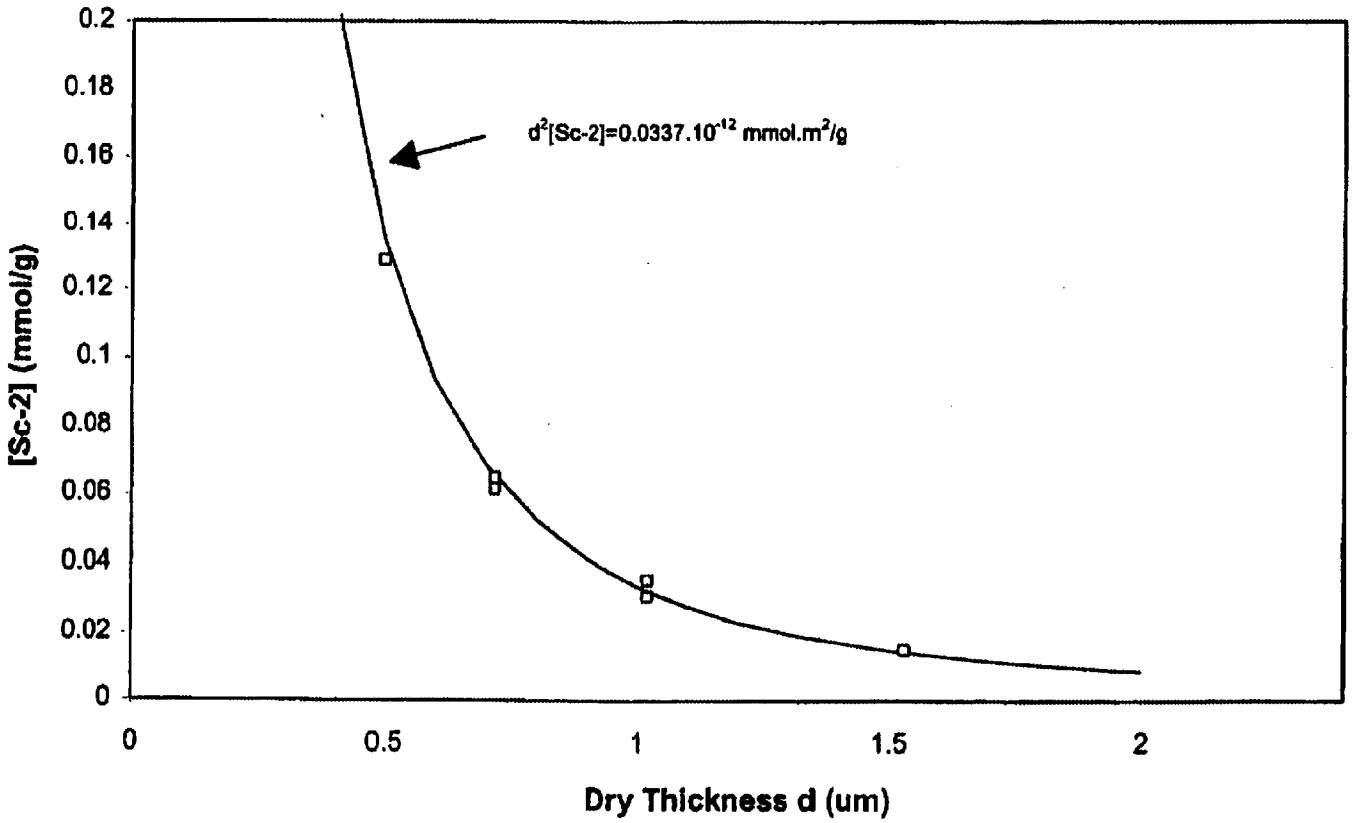
FIG. 2 shows experimental proof of the interlayer design parameter {[scavenger moiety SC-2].$d^2$}according to the invention, representing iso-colour mix lines. The open squares represent measured colour mix data for example 2 (taken from table 2). The drawn line, is the interlayer design parameter {[scavenger moiety SC-2].$d^2$}=$33.7*10^{-15}$ mmol $m^2$/g, which fits the experimental data points.

The data in table 2 and FIG. 2 illustrate the feature of the present invention that it is not the absolute amount of scavenger gelatin (defined by {[SC-2].d}) which determines the colour mix prevention but surprisingly the absolute amount of scavenger gelatin times the thickness d.

In table 3 it is shown that acceptable color mix prevention is obtained when the interlayer design parameter {[scavenger moiety].d$^2$}>$2*10^{-15}$ mmol.m$^2$/g. However, an unacceptable $D_{max}$ decrease is observed when the scavenger concentrations exceed 0.5 mmol/g interlayer gelatin or values of the interlayer design parameter {[scavenger].d$^2$}>$700*10^{-15}$ mmol.m$^2$/g Example 4 (Comparative Example)

Scavenger Molecules in the Conventional Oil/Water Emulsions for Interlayers of Photographic Colour Negative Film TAC (triacetyl cellulose) is used as photographic negative film support on which various photographic recording layers are coated in the same way as is shown in example 1 at the photographic base paper support. Although a higher number of recording layers are coated than in example 1, the same kind of interlayers (like BMC and GMC) between the different colour recording layers are applied. The scavenger molecules are introduced in the conventional oil/water emulsions of the interlayers at the same way like is described in example 1.

Example 5 (Inventive Example)

Scavenger Modified Gelatine Molecules in the Interlayers of Photographic Colour Negative Film TAC (triacetyl cellulose) is used in the same way as described in example 4 except the invented scavenger modified gelatines are introduced in the interlayers at the same way like is described in example 2.

A high efficiency improvement by the invented scavenger modified gelatine was observed as compared with the comparative sample in example 4. The scavenging improvement has about the same magnitude as is evaluated above in example 2 at the photographic base paper support. The influence of the colour coupler composition, which is different for colour paper and colour film recipes, on the scavenging efficiency appears to be of minor importance. The same limits for the thickness, the scavenger concentration in the interlayer and the parameter {[scavenger moiety].d$^2$} are found as is determined in example 1, 2, and 3 for photographic base papers.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Photographic material, comprising a photographic support and color sensitive recording layers on top of said support, said recording layers being separated from each other by at least one interlayer(s), which interlayers include a polymer comprising one or more scavenger moieties, wherein at least one interlayer is characterized by an interlayer design parameter, which is the product of the concentration of scavenger moieties per gram total polymer in the interlayer and the square of a dry thickness of the interlayer, being between $10\cdot10^{-15}$ and $700\cdot10^{-15}$ mmol.m$^2$/gram.

2. Photographic material according to claim 1, wherein the concentration of scavenger moieties in the polymer is lower than 0.5 mmol/g total polymer in the interlayer.

3. Photographic material according to claim 1, wherein the interlayer design parameter is between $40\cdot10^{-15}$ mmol m$^2$/gram and $250\cdot10^{-15}$ mmol m$^2$/gram.

4. Photographic material according to claim 1, wherein the dry thickness of the interlayer is less than 1.5 $\mu$m.

5. Photographic material according to claim 4, wherein the dry thickness of the interlayer is less than 1.0 $\mu$m.

6. Photographic material according to claim 1, wherein the interlayer further comprises scavenger molecules in oil-water emulsion.

7. Photographic material according to claim 1, wherein said interlayers comprise two or more polymers comprising one or more scavenger moieties, each of which polymers have a different scavenger load.

8. Photographic material according to claim 1, wherein said interlayers comprise a mixture of polymer comprising one or more scavenger moieties and one or more polymers lacking a scavenger moiety.

9. Photographic material according to claim 1, wherein said polymer is selected from the group consisting of casein, sericin, soluble collagen, gelatine, polyvinyl alcohol, polyvinyl glycol, polyvinyl pyrrolidone, lopyacrylamide, polyvinylimidazole, polyvinylpyrazole, cellulose derivatives and saccharide derivatives.

10. Photographic material according to claim 9, wherein said polymer consists of gelatine molecules selected from the group consisting of natural gelatines, alkaline processed gelatine, acid processed gelatine, hydrolysed gelatine, peptised gelatine resulting from enzymatic treatment and recombinant gelatines.

11. Photographic material according to claim 1, wherein said scavenger moiety is a scavenger molecule that is chemically linked to the polymer, wherein the scavenger molecule is selected from one or more of the group consisting of cresol, a pyrogallol, a cathechol, a hydrochinon, and a 2,4-disulphonamidophenol.

12. Photographic material according to claim 11, wherein said scavenger molecule is 2,5-dihydroxybenzoic acid.

13. Photographic material according to claim 1, wherein an amine group of the scavenger moiety is linked with a carboxylic acid group of an amino acid moiety in the polymer.

14. A method of manufacturing photographic material comprising a photographic support and color sensitive recording layers on top of said support, said recording layers being separated from each other by at least one interlayer(s), which interlayers include a polymer comprising one or more scavenger moieties comprising activated carboxylic acid groups, wherein an interlayer design parameter, which is the product of the concentration of scavenger moieties per gram total polymer in the interlayer and the square of a dry thickness of the interlayer is between $10 \cdot 10^{-15}$ and $700 \cdot 10^{-15}$ mmol.m$^2$/gram, wherein activation of the carboxylic acid groups of the scavenging moiety is carried out in an organic solvent.

15. A method according claim 14, wherein the said organic solvent is acetonitrile, tetrahydrofuran, 1,3-dioxane or 1,4-dioxane.

16. A method according claim 15, wherein the said organic solvent is tetrahydrofuran.

17. Photographic material according to claim 1, wherein said photographic support comprises a photographic base paper or a photographic polymer film.

18. Photographic material according to claim 1, wherein at least one surface of said photographic support is coated with a polymeric coating.

19. Photographic material according to claim 18, wherein said polymeric coating is a polyolefin resin.

20. Photographic material according to claim 1, wherein at least one surface of said photographic support is provided with a photographic polymer film, said photographic polymer film comprising polyethylene terephthalate or polyethylene naphthalate or triacetylcellulose.

21. Photographic material according to claim 1, further comprising a core layer with shield layers on both sides of the said core layer, wherein the core layer includes a polymer comprising one or more scavenger moieties and wherein each of the shield layers includes a polymer comprising a different concentration of one or more scavenger moieties.

22. Photographic material according to claim 1, wherein said interlayer further comprises additives selected from the group consisting of surface agent, stabiliser, pH controlling agent and high boiling organic solvent.

23. A method of manufacturing photographic material comprising providing multiple color sensitive recording layers separated from each other by interlayers, at least one interlayer comprising an effective amount of scavenger moieties linked to a polymer to reduce or prevent color contamination without affecting the maximum color density $D_{max}$ of neighboring color recording layers, wherein the amount of scavenger moieties in the interlayer is less than or equal to 0.5 mmol/g of polymer.

24. A method of manufacturing photographic material comprising providing multiple color sensitive recording layers separated from each other by interlayers, at least one interlayer comprising an effective amount of scavenger moieties linked to a polymer to reduce or prevent color contamination, wherein the concentration of scavenger moiety and the dry thickness of the interlayer are selected such that an interlayer design parameter, which is the product of the concentration of scavenger moieties per gram total polymer in the interlayer and the square of a dry thickness of the interlayer is between $10 \cdot 10^{-15}$ and $700 \cdot 10^{-15}$ mmol.m$^2$/gram for the interlayer.

25. Photographic material according to claim 1, wherein all of the interlayers are characterized by the interlayer design parameter being between $10 \cdot 10^{-15}$ and $700 \cdot 10^{-15}$ mmol.m$^2$/gram.

26. Photographic material according to claim 1, wherein the concentration of scavenger moieties in the polymer is lower than 0.3 mmol/g total polymer.

27. Photographic material according to claim 1, wherein the concentration of scavenger moieties in the polymer is lower than 0.15 mmol/g total polymer.

28. Photographic material according to claim 13, wherein the amine group of the scavenger moiety is linked to the carboxylic acid group of the amino acid moiety in the polymer via a spacer moiety.

29. Photographic material according to claim 1, wherein an activated carboxylic acid group of the scavenger moiety is linked with an amine group of an amino acid moiety in the polymer.

30. Photographic material according to claim 28, wherein the activated carboxylic acid group of the scavenger moiety is linked to the amine group of the amino acid moiety in the polymer via a spacer moiety.

31. Photographic material according to claim 18, wherein the polymeric coating is coated with a thin gelatine sublayer.

32. Photographic material according to claim 1, further comprising a core layer with shield layers on both sides of the said core layer, wherein the core layer includes a polymer comprising one or more scavenger moieties and wherein said shield layers lack a scavenger moiety.

* * * * *